US010989013B1

(12) United States Patent
Helms et al.

(10) Patent No.: US 10,989,013 B1
(45) Date of Patent: Apr. 27, 2021

(54) BUOYANCY ASSIST TOOL WITH CENTER DIAPHRAGM DEBRIS BARRIER

(71) Applicant: HALLIBURTON ENERGY SERVICES, INC., Houston, TX (US)

(72) Inventors: Lonnie Carl Helms, Humble, TX (US); Min Mark Yuan, Katy, TX (US); Mayur Narain Ahuja, Friendswood, TX (US); Ishwar Dilip Patil, Spring, TX (US); Byong Jun Kim, Cypress, TX (US); Rajesh Parameshwaraiah, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/689,272

(22) Filed: Nov. 20, 2019

(51) Int. Cl.
*E21B 33/12* (2006.01)
*E21B 34/06* (2006.01)
*E21B 33/126* (2006.01)

(52) U.S. Cl.
CPC ..... *E21B 33/126* (2013.01); *E21B 33/12* (2013.01); *E21B 34/063* (2013.01)

(58) Field of Classification Search
CPC ..... E21B 33/12; E21B 34/063
See application file for complete search history.

(56) References Cited

U.S. PATENT DOCUMENTS 3,463,351 A 8/1969 Mills
3,779,263 A 12/1973 Edwards et al.
3,980,134 A 9/1976 Amancharla
4,457,376 A 7/1984 Carmody et al.
5,150,756 A 9/1992 Hassanzadeh
5,479,986 A 1/1996 Gano et al.
5,765,641 A 6/1998 Shy et al.
6,026,903 A 2/2000 Shy et al.
6,076,600 A 6/2000 Vlck, Jr. et al.
6,161,622 A 12/2000 Robb et al.
6,324,904 B1 12/2001 Ishikawa et al.
6,450,263 B1 9/2002 Schwendemann
6,505,685 B1 1/2003 Sullaway et al.
6,622,798 B1 9/2003 Rogers et al.
6,651,748 B2 11/2003 Sullaway et al.
6,672,389 B1 1/2004 Hinrichs
(Continued)

FOREIGN PATENT DOCUMENTS

EP 0681087 B1 9/2000
JP 6551001 B2 7/2019
(Continued)

OTHER PUBLICATIONS

International Search Report and Written Opinion dated Jul. 21, 2020, issued in PCT Application No. PCT/US2019/059864.
(Continued)

*Primary Examiner* — Giovanna Wright
(74) *Attorney, Agent, or Firm* — McAfee & Taft

(57) ABSTRACT

A downhole apparatus comprises a casing string with a removable plug therein to block flow therethrough. A flow barrier is positioned in the casing below the removable plug and the removable plug and the flow barrier defining a buoyancy chamber therebetween. A debris barrier positioned above the removable plug comprises a rigid annular ring with a flexible diaphragm covering the center opening defined by the annular ring.

20 Claims, 5 Drawing Sheets

(56) References Cited

U.S. PATENT DOCUMENTS

| | | | |
|---|---|---|---|
| 6,758,281 | B2 | 7/2004 | Sullaway et al. |
| 7,270,191 | B2 | 9/2007 | Drummond et al. |
| 8,505,621 | B2 | 8/2013 | Telfer et al. |
| 9,309,752 | B2 | 4/2016 | Talley et al. |
| 9,441,437 | B2 | 9/2016 | Fripp et al. |
| 9,441,446 | B2 | 9/2016 | Fripp et al. |
| 9,518,445 | B2 | 12/2016 | Noske |
| 9,540,904 | B2 | 1/2017 | Petrowsky |
| 9,593,542 | B2 | 3/2017 | Getzlaf et al. |
| 10,138,707 | B2 | 11/2018 | Tolman et al. |
| 2002/0185273 | A1 | 12/2002 | Aronstam et al. |
| 2003/0116324 | A1 | 6/2003 | Dawson et al. |
| 2003/0217844 | A1 | 11/2003 | Moyes |
| 2008/0073075 | A1 | 3/2008 | Buyers et al. |
| 2008/0115942 | A1 | 5/2008 | Keller et al. |
| 2010/0270031 | A1 | 10/2010 | Patel |
| 2010/0294376 | A1 | 11/2010 | O'Brien et al. |
| 2011/0042099 | A1 | 2/2011 | Williamson, Jr. et al. |
| 2011/0253392 | A1 | 10/2011 | May et al. |
| 2012/0111566 | A1 | 5/2012 | Sherman et al. |
| 2014/0174757 | A1 | 6/2014 | Fripp et al. |
| 2014/0216756 | A1 | 8/2014 | Getzlaf et al. |
| 2014/0224505 | A1 | 8/2014 | Ramon |
| 2014/0338923 | A1 | 11/2014 | Fripp et al. |
| 2015/0107843 | A1 | 4/2015 | Talley et al. |
| 2015/0129205 | A1 | 5/2015 | Hofman et al. |
| 2015/0240596 | A1 | 8/2015 | Horwell |
| 2016/0177668 | A1 | 6/2016 | Watson et al. |
| 2016/0333658 | A1 | 11/2016 | Keshishian et al. |
| 2017/0096875 | A1 | 4/2017 | Ravensbergen et al. |
| 2017/0138153 | A1 | 5/2017 | Getzlaf et al. |
| 2018/0003004 | A1 | 1/2018 | Norman et al. |
| 2018/0058179 | A1 | 3/2018 | Nuryaningsih et al. |
| 2018/0080308 | A1 | 3/2018 | Dedman et al. |
| 2018/0219200 | A1 | 8/2018 | Albukrek et al. |
| 2018/0262127 | A1 | 9/2018 | Gooneratne et al. |
| 2018/0371869 | A1 | 12/2018 | Kellner et al. |
| 2019/0352994 | A1* | 11/2019 | Giroux ..... E21B 43/10 |
| 2019/0352995 | A1 | 11/2019 | Giroux et al. |

FOREIGN PATENT DOCUMENTS

| | | | |
|---|---|---|---|
| WO | 2015073001 | A1 | 5/2015 |
| WO | 2016176643 | A1 | 11/2016 |
| WO | 2019099046 | A1 | 5/2019 |

OTHER PUBLICATIONS

International Search Report and Written Opinion dated Jul. 23, 2020, issued in PCT Application No. PCT/US2019/061714.
International Search Report and Written Opinion dated Aug. 11, 2020, issued in PCT Application No. PCT/US2019/065862.
International Search Report and Written Opinion dated Aug. 31, 2020, issued in PCT Application No. PCT/US2020/012307.
International Search Report and Written Opinion dated Aug. 14, 2018, issued in PCT Application No. PCT/US2017/062528.
International Search Report and Written Opinion dated Sep. 19, 2019, issued in PCT Application No. PCT/US2018/066889.
International Search Report and Written Opinion dated Sep. 19, 2019, issued in PCT Application No. PCT/US2018/067161.
International Search Report and Written Opinion dated Aug. 14, 2019, issued in PCT Application No. PCT/US2019/064051.
International Search Report and Written Opinion dated Jan. 14, 2020, issued in PCT Application No. PCT/US2019/027502.
International Search Report and Written Opinion dated Feb. 5, 2020, issued in PCT Application No. PCT/US2019/0031541.
International Search Report and Written Opinion dated Jan. 21, 2020, issued in PCT Application No. PCT/US2019/028508.
International Search Report and Written Opinion dated May 25, 2020, issued in PCT Application No. PCT/US2019/056206.
International Search Report and Written Opinion dated May 26, 2020, issued in PCT Application No. PCT/US2019/059757.
International Search Report and Written Opinion dated Jan. 16, 2020, issued in PCT Application No. PCT/US2019/027625.
International Search Report and Written Opinion dated Oct. 27, 2020, issued in PCT Application No. PCT/US2020/039399.

* cited by examiner

BUOYANCY ASSIST TOOL WITH CENTER DIAPHRAGM DEBRIS BARRIER

The length of deviated or horizontal sections in well bores is such that it is sometimes difficult to run well casing to the desired depth due to high casing drag. Long lengths of casing create significant friction and thus problems in getting casing to the toe of the well bore. Creating a buoyant chamber in the casing utilizing air or a fluid lighter than the well bore fluid can reduce the drag making it easier to overcome the friction and run the casing to the desired final depth.

DESCRIPTION

Figure 1:
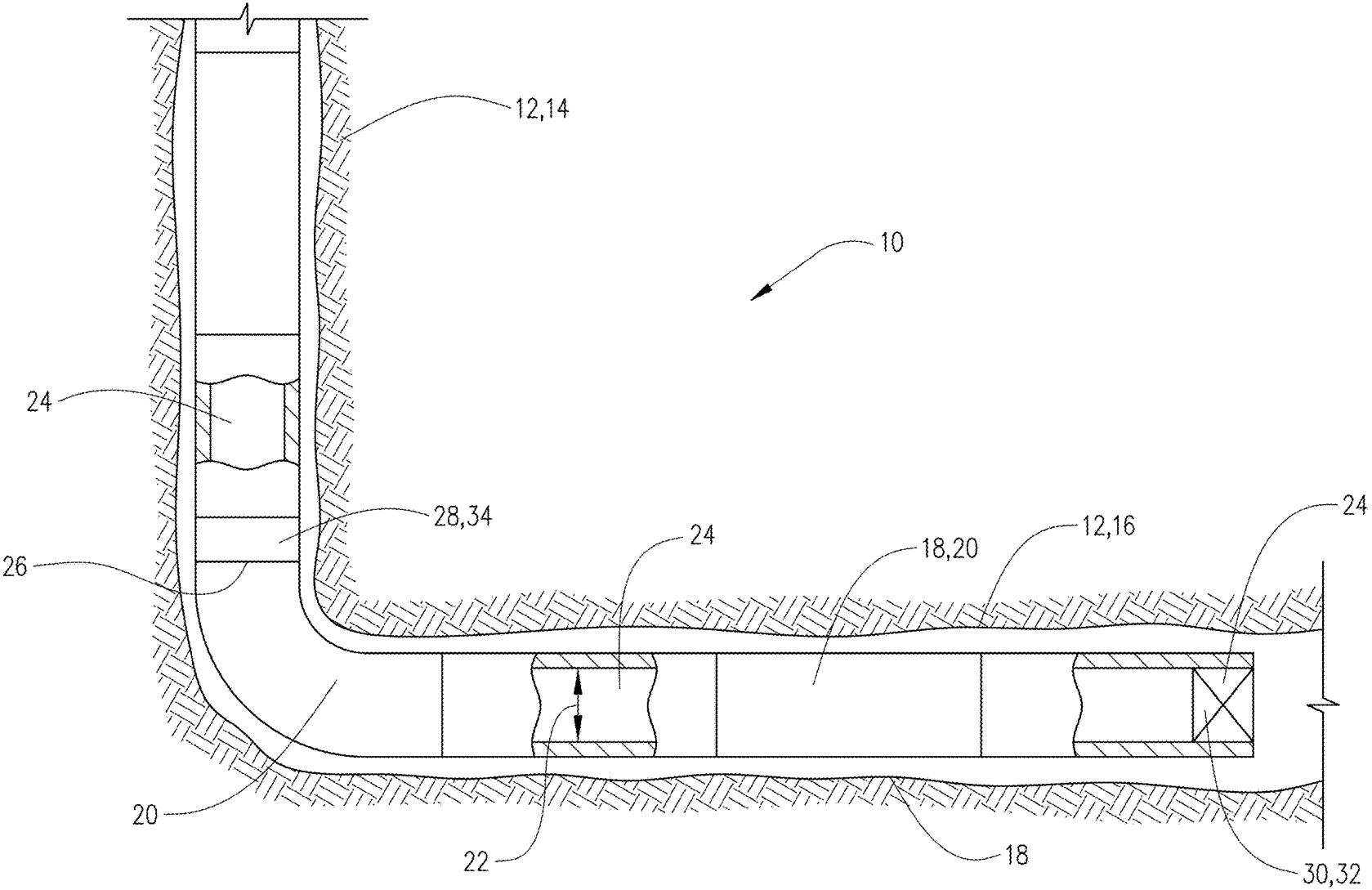
FIG. 1 is a schematic view of an exemplary well bore with a well casing including a buoyancy chamber therein.
Figure 2:
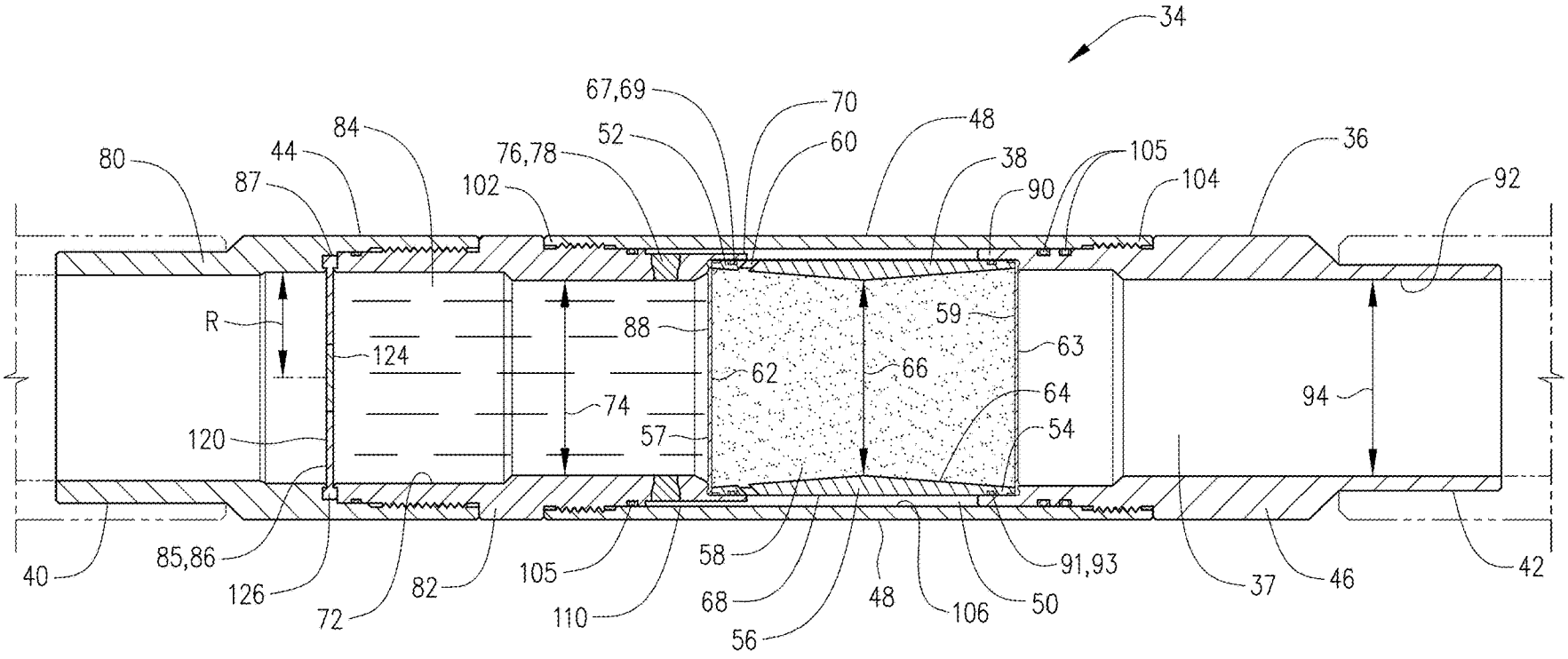
FIG. 2 is a cross section of a buoyancy assist tool of the current disclosure.

The following description and directional terms such as above, below, upper, lower, uphole, downhole, etc., are used for convenience in referring to the accompanying drawings. One who is skilled in the art will recognize that such directional language refers to locations in the well, either closer or farther from the wellhead and the various embodiments of the inventions described and disclosed here may be utilized in various orientations such as inclined, deviated, horizontal and vertical.

Referring to the drawings, a downhole apparatus 10 is positioned in a well bore 12. Well bore 12 includes a vertical portion 14 and a deviated or horizontal portion 16. Apparatus 10 comprises a casing string 18 which is made up of a plurality of casing joints 20. Casing joints 20 may have inner diameter or bore 22 which defines a central flow path 24 therethrough. Well casing 18 defines a buoyancy chamber 26 with upper end or boundary 28 and lower end or boundary 30. Buoyancy chamber 26 will be filled with a buoyant fluid which may be a gas such as nitrogen, carbon dioxide, or air but other gases may also be suitable. The buoyant fluid may also be a liquid such as water or diesel fuel or other like liquid. The important aspect is that the buoyant fluid has a lower specific gravity than the well fluid in the well bore 12 in which casing 18 is run. The choice of gas or liquid, and which one of these is used is a factor of the well conditions and the amount of buoyancy desired.

Lower boundary 30 may comprise a float device such as a float shoe or float collar 32. As is known, such float devices will generally allow fluid flow downwardly therethrough but will prevent flow upwardly into the casing. The float devices are generally a one-way check valve. The float device 32 is thus a fluid barrier that will be configured such that it will hold the buoyant fluid in the buoyancy chamber 26 until additional pressure is applied after the release of the buoyancy fluid from the buoyancy chamber. The upper boundary 28 is defined by a buoyancy assist tool as described herein.

Buoyancy assist tool 34 includes an outer case 36 defining flow path 37 therethrough that is connectable in casing string 18. Buoyancy assist tool 34 comprises a plug assembly 38 that is connected to and positioned in outer case 36. Buoyancy assist tool 34 has upper end 40 and lower end 42. Buoyancy assist tool 34 is connectable in the casing string at the upper and lower ends 40 and 42 thereof and forms a part of the casing string 18 lowered into well bore 12.

Outer case 36 comprises an upper outer case 44 and a lower outer case 46. A connecting shield 48 is connected to and extends between upper outer case 44 and lower outer case 46. Outer case 36 and plug assembly 38 define an annular space 50 therebetween.

Plug assembly 38 has upper end 52 and lower end 54. Plug assembly 38 is connected to upper outer case 44 at the upper end 52 thereof and to lower outer case 46 at the lower end 54 thereof. The plug assembly may be threadedly connected or connected by other means known in the art. Plug assembly 38 may comprise a plug housing 56 with upper and lower ends 52 and 54 which are the upper and lower ends of the plug assembly 38. A degradable plug or degradable core 58 is fixed in housing 56. Degradable core 58 has upper end 57 and lower end 59, which may be for example coincident with the upper and lower ends 52 and 54 of plug housing 56. The degradable core may be a matrix of sand and salt but can be other degradable substances that can be degraded with fluids or other means once the casing string 18 is lowered into the well bore to a desired location in the well. Plug housing 56 has a plurality of housing ports 60 defined through the wall thereof. Housing ports 60 communicate the annular space 50 with the degradable plug or core 58 so that fluid passing therethrough can contact degradable plug 58 and can degrade the plug to remove it from plug housing 56 to create a full bore flow path therethrough.

Buoyancy assist tool 34 may include an upper impermeable membrane 62 positioned across upper end 57 of degradable plug 58 and a lower impermeable membrane 63 positioned across the lower end 59 of degradable plug 58. Membranes 62 and 63 will prevent fluid thereabove from contacting the degradable plug at the upper end of the plug assembly 38 prior to the time casing string 18 is placed at the desired location in well bore 12. Likewise, the impermeable membrane 63 will prevent fluid in the buoyancy chamber 26 from contacting the degradable plug 58 until such time as degradation of the plug is desired. Upon degradation of the plug 58 the membranes 62 and 63 will be easily ruptured by fluid flowing through the casing string 18, including outer case 36.

Plug housing 56 has an inner surface 64 defining a diameter 66 and has an outer surface 68. In the embodiment described diameter 66 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Upper end 40 of buoyancy assist tool 34 is likewise the upper end of upper outer case 44. Upper outer case 44 has a lower end 70. Plug assembly 38 is connected at its upper end 52 to the lower end 70 of upper outer case 44. Outer surface 68 of plug housing 56 may have a groove 67 with an O-ring seal 69 therein to sealingly engage an inner surface of upper outer case 44. Upper outer case 44 has inner surface 72 which defines an inner diameter 74 that is a minimum inner diameter of upper outer case 44. Inner surface 72 of upper outer case 44 defines a second inner diameter 75 that is larger than first inner diameter 74. In the embodiment shown upper outer case 44 has a port 76 therethrough. Inner diameter 74 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

A rupture disc or other rupturable membrane 78 is positioned in port 76 in upper outer case 44. Rupture disc 78 will prevent flow through port 76 until a desired or pre-determined pressure is reached in casing string 18. Upon reaching the predetermined pressure the rupture disc 78 will rupture and fluid will be communicated from casing string 18 through port 76 into annular space 50. Fluid will pass from annular space 50 through housing ports 60 and will contact the degradable plug 58. The fluid passing therethrough may be referred to as a degrading fluid. The degrading fluid may be any fluid utilized to degrade the degradable plug and may be water or other degrading fluid.

The degrading fluid is in fluid chamber 84, which has upper end 86 and lower end 88. Upper membrane 62 prevents the fluid in fluid chamber 84 from contacting degradable plug 58 prior to the rupturing of rupture disc 78. Upper outer case 44 may be a two-piece outer case comprising an upper portion 80 that is threadedly and sealingly connected to lower portion 82. Lower portion 82 connects to plug assembly 38 as shown in the figures. Upper outer case 44 may define fluid chamber 84 which is a closed fluid chamber 84. Fluid chamber 84 has a debris barrier 85 that extends across upper end 86 thereof. Fluid in fluid chamber 84 is thus trapped between debris barrier 85 and the upper membrane 62. There are certain formations in which it is not desirable to pump water. In those instances oil or another fluid other than water may be utilized to fracture or otherwise treat the formation. Where, for example, water is the degrading fluid, but not the treatment fluid, water will be contained in the fluid chamber 84 such that upon reaching the appropriate position in the well oil or other fluid may be pumped through the casing string 18 so that the water in fluid chamber 84 will contact the degradable plug 58 as further described herein. The water in fluid chamber 84 passes into and from annular space 50 through ports 60 in plug housing 56 and will contact the degradable plug 58 until it is degraded or dissolved.

Lower outer case 46 has upper end 90 and a lower end which is the lower end 42 of buoyancy assist tool 34. Upper end 90 of lower outer case 46 is connected to lower end 54 of plug assembly 38. Outer surface 68 of plug housing 56 may have a groove 91 with an O-ring seal 93 therein to sealingly engage lower outer case 46. Lower outer case 46 has inner surface 92 defining an inner diameter 94. Inner diameter 94 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Connecting sleeve 48 has upper end 102 and lower end 104. Connecting sleeve 48 is connected at its upper end 102 to an outer surface of upper outer case 44 and is connected at its lower end 104 to an outer surface of lower outer case 46. O-ring seals 105 may be positioned in grooves in the outer surfaces of the upper and lower outer cases 44 and 46 respectively to sealingly engage an inner surface 106 of connecting shield 48. Inner surface 106 of connecting shield 48 defines an inner diameter 108. An annular passageway 110 is defined by and between upper outer case 44 and connecting shield 48. Annular passageway 110 communicates fluid delivered through port 76 into annular space 50. Fluid is communicated through ports 60 so that it will contact degradable plug 58 to dissolve or degrade the plug.

Figure 3:
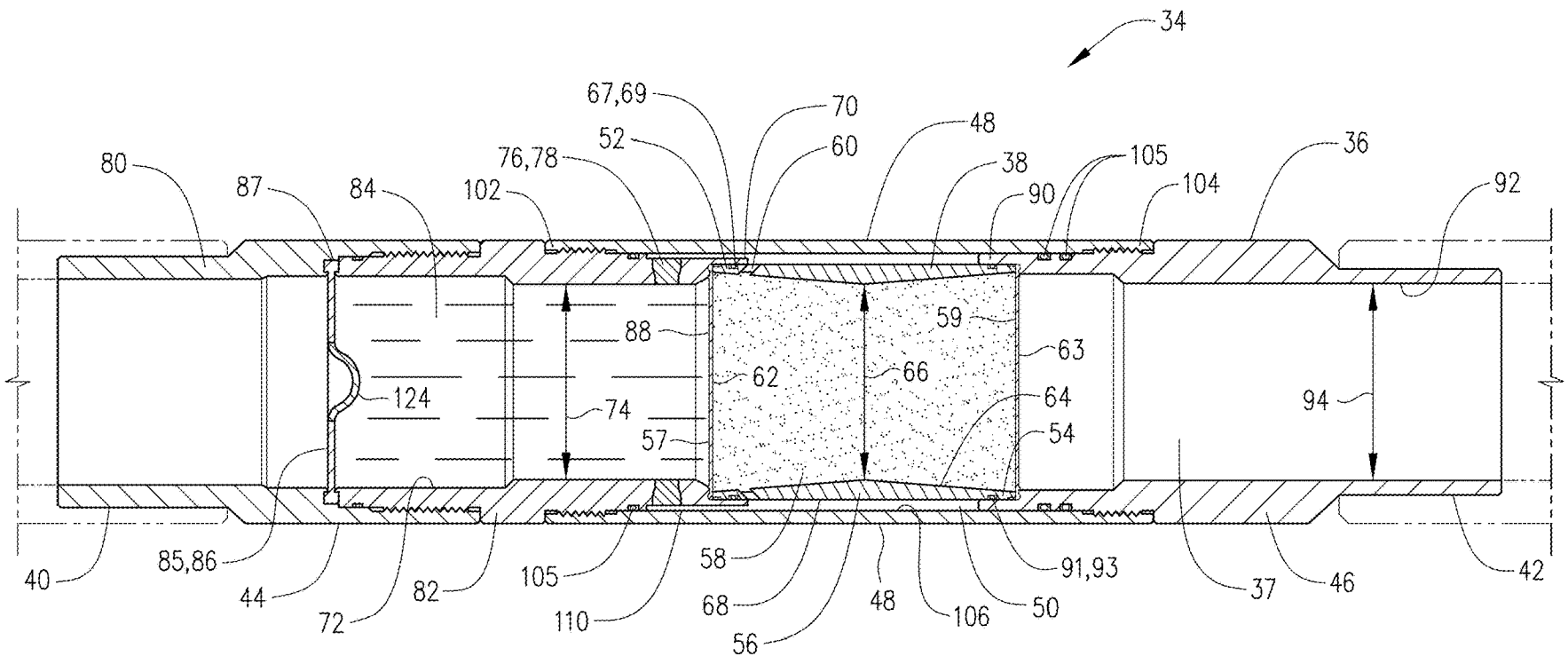
FIG. 3 is a cross section of a buoyancy assist tool of FIG. 2 after pressure has been applied to the debris barrier.
Figure 4:
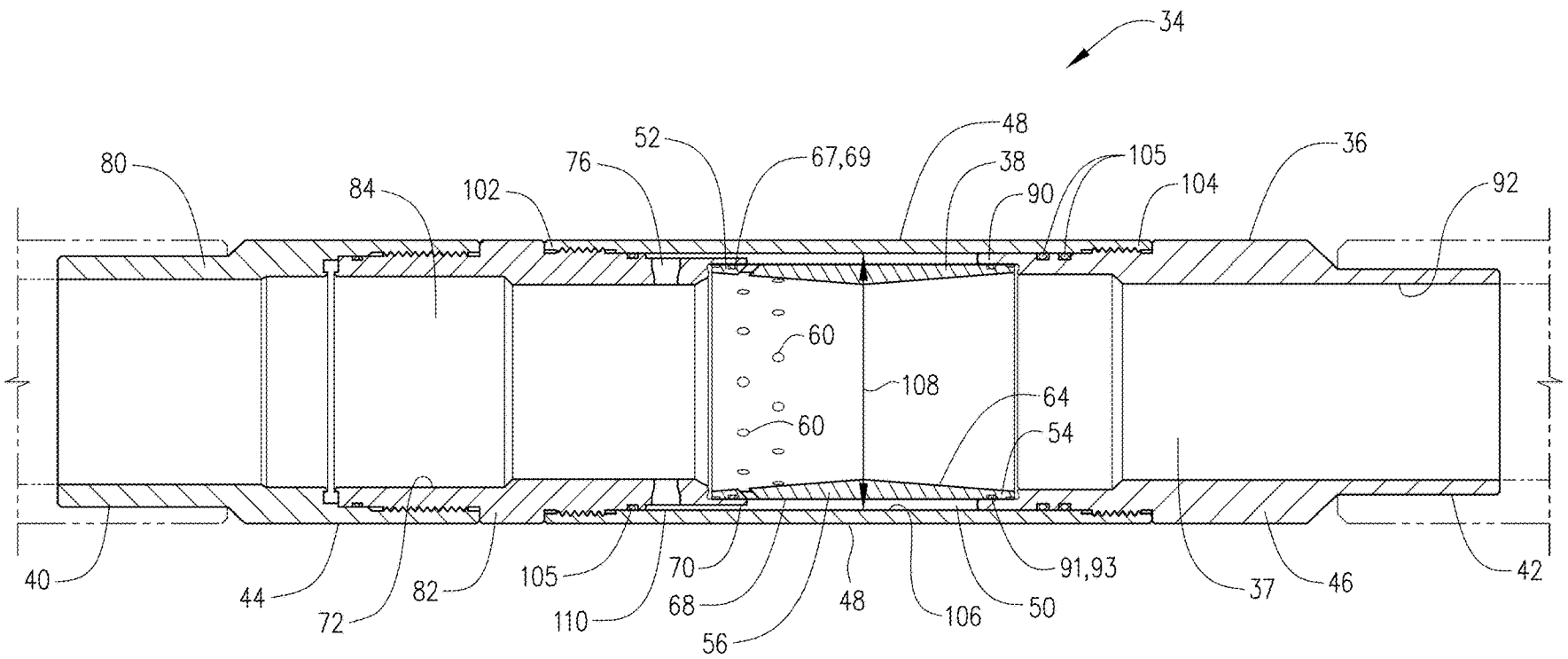
FIG. 4 is a cross section of a buoyancy assist tool of FIG. 2 after the plug has degraded and the plug and debris barrier removed from the buoyancy assist tool.
Figure 5:
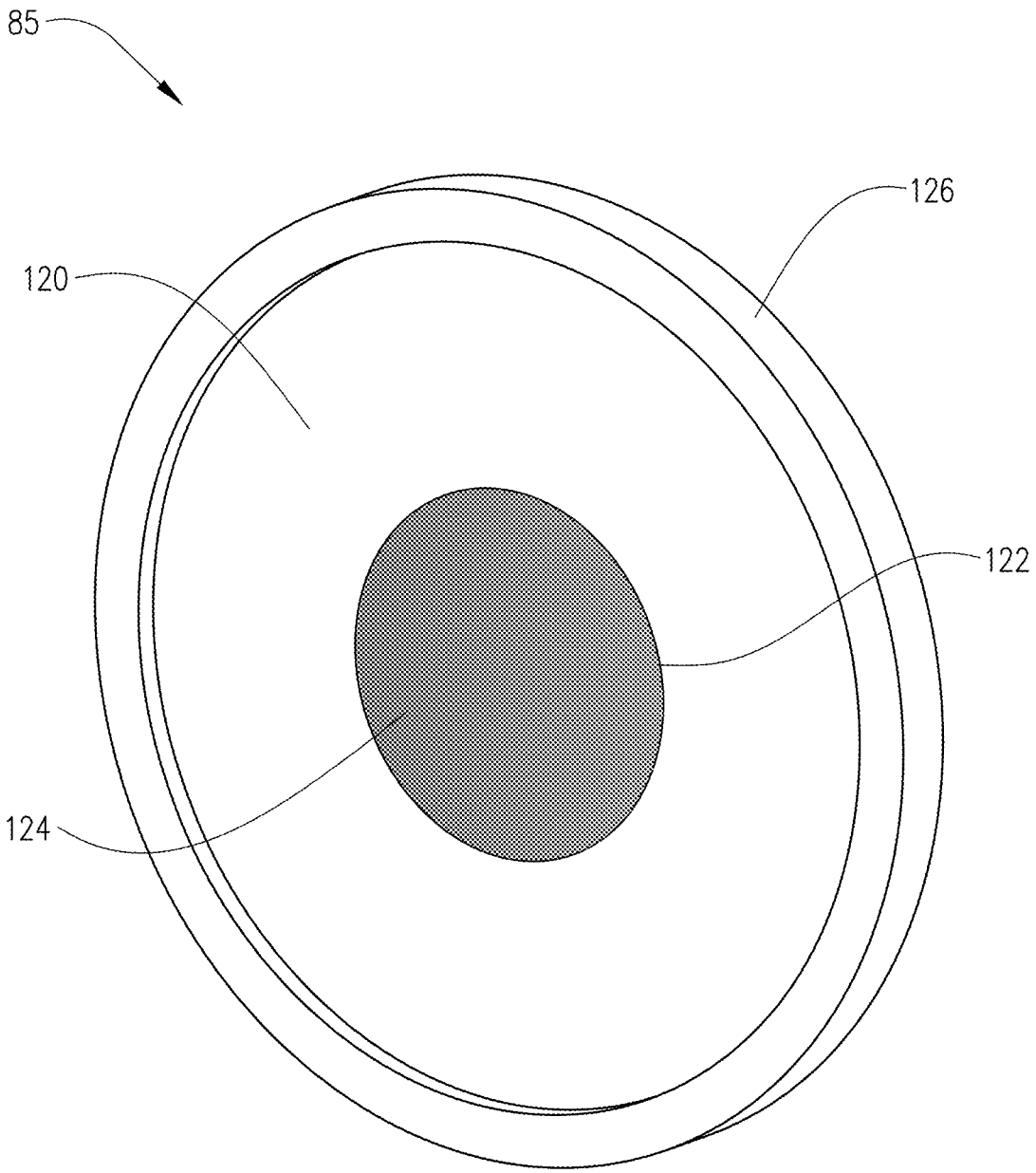
FIG. 5 is a perspective view of the debris barrier.

Debris barrier 85 is comprised of a rigid annular ring 120 with a center opening 122. A flexible, or stretchable diaphragm 124 extends across and covers the opening 122. Annular ring 120 is comprised of a first material and stretchable diaphragm 124 is comprised of a second dissimilar material. The first material is a rigid material, and may be a rigid, brittle material that will shatter as a result of the pressure applied thereto, or as a result of impact with the casing string 18 or the flow barrier 32 as it passes therethrough. Brittle is used herein as it is commonly understood, and is a material that will shatter with an impact. Rigid annular ring 120 extends radially inwardly at least half the length of the radius R of inner diameter 75 of the upper outer case 44. The first material may comprise for example, a phenolic, a ceramic or tempered glass. The second material may comprise for example an elastomeric material, and will likewise be completely removed from the casing string upon the application of pressure and degradation of the degradable plug. Thus, as described herein, upon the application of a predetermined pressure, the debris barrier 85 along with degradable plug 58 will be completely removed from the casing string 18. A connecting ring 126 at the outer circumference of the annular ring 120 is fixed to the outer case 36, and may be trapped between upper and lower portions of upper outer case 44. Flexible diaphragm 124, as shown in FIG. 3, will bulge downwardly into fluid chamber 84. The pressure in fluid chamber 84 will increase until the predetermined pressure required to rupture disc 78 is reached.

In operation casing string 18 is lowered into well bore 12 to a desired location. Running a casing such as casing 18 in deviated wells and long horizontal wells often results in significantly increased drag forces and may cause a casing string to become stuck before reaching the desired location in the well bore. For example, when the casing produces more drag forces than the available weight to slide the casing down the well, the casing may become stuck. If too much force is applied to the casing string 18 damage may occur. The buoyancy assist tool 34 as described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into well bore 12 buoyancy chamber 26 will aid in the proper placement since it will reduce friction as the casing 18 is lowered into horizontal portion 16 to the desired location.

Once the casing string 18 has reached the desired position in the well bore, pressure is increased and fluid pumped through the casing string 18. The pressure will cause flexible diaphragm 124 to bulge downwardly into fluid chamber 84 to apply a downward pressure to the fluid in chamber 84 until at a predetermined pressure rupture disc 78 bursts. Once rupture disc 78 bursts, degrading fluid from fluid chamber 84 will pass through port 76 into passageway 110 and into annular space 50. Fluid will pass from annular space 50 through ports 60 and will contact the degradable plug 58. A sufficient quantity of the degrading fluid will be utilized to degrade degradable plug 58 so that it will be completely removed from plug housing 56.

Typically, once the degradation process reaches a certain level, the degradable plug 58 will break up, and at that point both of upper and lower membranes 62 and 63 will likewise be broken, and the pieces thereof along with pieces of the degradable plug will pass through casing string 18. The pressure in the casing string 18 will cause the flexible diaphragm 124 to be torn into small pieces, and annular ring 120 will shatter into small pieces as a result of the applied pressure, or impact with the casing string 18 or flow barrier 32. The pieces of shattered annular ring 120, along with any pieces of the flexible diaphragm 124 will pass through the casing string 18 and the flow barrier 32. Debris barrier 85 will therefore be removed from the casing string 18, and will not present a restriction to any tool that will otherwise pass through the casing string 18.

A downhole apparatus comprises a casing string. A removable plug is positioned in the casing string and configured to block flow therethrough. A buoyancy chamber is defined by the removable plug and flow barrier in the casing string below the removable plug. A debris barrier is positioned above the removable plug, and the debris barrier and removable plug define a fluid chamber therebetween. The debris barrier comprises a rigid annular ring and a stretchable diaphragm extending across a central opening defined by the rigid annular ring.

The rigid annular ring extends radially inwardly from the casing. In one embodiment the rigid annular ring extends radially inwardly at least about half the length of a radius of the casing at the location in the casing where the debris barrier is positioned. The rigid annular ring may be comprised of a brittle material and the flexible diaphragm is configured to bulge downwardly into the fluid chamber upon the application of fluid pressure in the casing above the flexible diaphragm. The casing has a rupture disc therein configured to rupture as a result of the flexible diaphragm bulging downwardly into the fluid chamber. The removable plug may be for example a degradable plug. The fluid in the fluid chamber comprises degrading fluid and the degradable plug will degrade as a result of contact with the degrading fluid from the fluid chamber.

A downhole apparatus may also comprise an outer case connected at upper and lower ends thereon in a casing string. A degradable plug is positioned in the outer case and a debris barrier comprising a rigid outer ring connected to the outer case and a flexible diaphragm extending across a center opening of the outer ring is connected in the outer case above the degradable plug. The debris barrier and degradable plug define a fluid chamber therebetween. The degradable plug and outer case define an annulus therebetween. The downhole apparatus may further comprise a rupture disc in a port in the outer case. The flexible diagram is configured to bulge downwardly into the fluid chamber upon the application of fluid pressure thereabove. The rupture disc is configured to rupture and permit flow through the port into the annulus as a result of the bulging flexible diaphragm. A flow barrier in the casing string below the degradable plug and the degradable plug defining a buoyancy chamber therebetween. The rigid annular ring may be made of a brittle material configured to shatter and pass through the flow barrier, and may be selected, for example, from the group comprising phenolic, ceramics and tempered glass. The rigid ring may extend radially inwardly at least half the length of the radius of the outer case. The flexible diaphragm may comprise an elastomeric diaphragm.

An additional embodiment of a downhole apparatus comprises an outer case connectable at upper and lower ends in a casing string. A rigid annular ring is connected to the outer case. A flexible diaphragm is attached to the rigid ring and covers a central opening of the rigid ring. A removable plug is positioned in the outer case below the flexible diaphragm, and the removable plug and flexible diaphragm define a fluid chamber therebetween. The outer case may be connected in a casing string, and a flow barrier connected in the casing string below the removable plug. The removable plug and flow barrier define a buoyancy chamber therebetween. The removable plug may comprise a degradable plug. The flexible diaphragm is configured to bulge downwardly into the fluid chamber upon the application of downward pressure thereto. The outer case has a port therein to communicate fluid from the fluid chamber to the degradable plug as a result of the flexible diaphragm bulging downwardly therein. A rupture disc in the port is configured to burst as a result of the flexible diaphragm bulging into the fluid chamber.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A downhole apparatus comprising:
- a casing string defining a flow path therethrough;
- a removable plug positioned in the casing string and configured to block flow therethrough;
- a flow barrier in the casing string below the removable plug, the flow barrier and removable plug defining a buoyancy chamber therebetween;
- a debris barrier positioned above the removable plug, the debris barrier and removable plug defining a fluid chamber therebetween, the debris barrier comprising:
  - a rigid annular ring extending radially inwardly into the flow path; and
  - a flexible diaphragm extending across a central opening defined by the rigid annular ring.

2. The downhole apparatus of claim 1, the rigid annular ring extending radially inwardly from the casing at least about half the length of a radius of the casing at the location in the casing where the debris barrier is positioned.

3. The downhole apparatus of claim 1, the rigid annular ring comprised of a brittle material.

4. The downhole apparatus of claim 1, the flexible diaphragm configured to bulge downwardly into the fluid chamber upon the application of fluid pressure in the casing above the flexible diaphragm.

5. The downhole apparatus of claim 4, the casing having a rupture disc therein, the rupture disc configured to rupture as a result of the flexible diaphragm bulging downwardly into the fluid chamber.

6. The downhole apparatus of claim 1, the removable plug comprising a degradable plug.

7. The downhole apparatus of claim 6, a fluid in the fluid chamber comprising a degrading fluid.

8. A downhole apparatus comprising:
- an outer case defining a flow path therethrough connected at upper and lower ends thereof in a casing string;
- a degradable plug positioned in the outer case; and
- a debris barrier comprising;
  - a rigid annular ring connected to the outer case and extending radially inwardly into the flow path; and
  - a flexible diaphragm extending across a center opening of the annular ring, the debris barrier and degradable plug defining a fluid chamber therebetween.

9. The downhole apparatus of claim 8, the degradable plug and outer case defining an annulus therebetween, further comprising a rupture disc in a port in the outer case, the flexible diaphragm configured to bulge downwardly into the fluid chamber upon the application of fluid pressure thereabove, the rupture disc configured to rupture and permit flow through the port into the annulus as a result of the bulging flexible diaphragm.

10. The downhole apparatus of claim 9, further comprising a flow barrier in the casing string below the degradable plug, the flow barrier and degradable plug defining a buoyancy chamber therebetween.

11. The downhole apparatus of claim 10, the rigid annular ring comprising a brittle material configured to shatter and pass through the flow barrier.

12. The downhole apparatus of claim 11, the rigid ring extending radially inwardly at least half the length of the radius of the outer case.

13. The downhole apparatus of claim 10, the rigid ring comprised of a material selected from the group comprising phenolic, ceramics and tempered glass.

14. The downhole apparatus of claim 8, the rigid ring comprising a brittle material and the flexible diaphragm comprising an elastomeric diaphragm bonded thereto.

15. A downhole apparatus comprising:

an outer case defining a flow path therethrough connectable at upper and lower ends in a casing string;

a rigid ring connected to the outer case and extending radially inwardly into the flow path;

a flexible diaphragm attached to the rigid ring and covering a central opening of the rigid ring; and a removable plug positioned in the outer case below the flexible diaphragm, the removable plug and flexible diaphragm defining a fluid chamber therebetween.

16. The downhole apparatus of claim 15, the outer case being connected in a casing string, further comprising a flow barrier connected in the casing string below the removable plug, the removable plug and flow barrier defining a buoyancy chamber therebetween.

17. The downhole apparatus of claim 16, the removable plug comprising a degradable plug.

18. The downhole apparatus of claim 16, the flexible diaphragm configured to bulge downwardly into the fluid chamber upon the application of downward pressure thereto.

19. The downhole apparatus of claim 16, the outer case having a port therein to communicate fluid from the fluid chamber to the degradable plug as a result of the flexible diaphragm bulging downwardly therein.

20. The downhole apparatus of claim 19 further comprising a rupture disc in the port, the rupture disc configured to burst as a result of the flexible diaphragm bulging into the fluid chamber.

* * * * *